US005468204A

United States Patent [19]

Huang

[11] Patent Number: 5,468,204

[45] Date of Patent: Nov. 21, 1995

[54] HYDRAULIC EXERCISER WITH RECIPROCATING HYDRAULIC CYLINDER PAIR

[75] Inventor: Yi-Fa Huang, Tao-Yuan Hsien, Taiwan

[73] Assignee: Michelle Hsiu-Feng Wang, Chia-Yi City, Taiwan

[21] Appl. No.: 321,816

[22] Filed: Oct. 5, 1994

[51] Int. Cl.[6] ..... A63B 21/008

[52] U.S. Cl. ..... 482/112; 482/80

[58] Field of Search ..... 482/111, 112, 482/52, 79, 80, 113

[56] References Cited

U.S. PATENT DOCUMENTS

| | | | |
|---|---|---|---|
| 4,563,001 | 1/1986 | Terauds | 482/112 |
| 5,183,453 | 2/1993 | Yamashiro | 482/112 |
| 5,222,580 | 6/1993 | Wang | 482/113 |
| 5,236,407 | 8/1993 | Wang . | |
| 5,370,592 | 12/1994 | Wu | 482/112 |

*Primary Examiner*—Lynne A. Reichard
*Attorney, Agent, or Firm*—Bacon & Thomas

[57] ABSTRACT

A hydraulic exerciser includes an elongated hollow support formed with an axial through bore, and a pair of hydraulic cylinders, each of which has a cylinder body and a plug unit which is secured on one end of the cylinder body and which mounts pivotably the cylinder body on a respective one of two ends of the hollow support. The plug unit is formed with a fluid passage for communicating the interior of the cylinder body and the through bore of the hollow support, and includes a first plug member extending sealingly and securely into the cylinder body and having an axial threaded extension which extends out of the cylinder body, and a second plug member having a head section formed with a radial threaded hole which engages threadedly the threaded extension and a shank section extending sealingly and rotatably into the respective one of the two ends of the hollow support. A pin at each of the two ends of the hollow support extends into an annular peripheral groove formed in the shank section of a corresponding second plug member to mount rotatably the plug units on the hollow support.

2 Claims, 6 Drawing Sheets

HYDRAULIC EXERCISER WITH RECIPROCATING HYDRAULIC CYLINDER PAIR

BACKGROUND OF THE INVENTION

1. Field of the Invention

The invention relates to a hydraulic exerciser, more particularly to a hydraulic exerciser which is provided with a pair of reciprocating hydraulic cylinders.

2. Description of the Related Art

U.S. Pat. No. 5,236,407 discloses a hydraulic exerciser which is provided with a pair of reciprocating hydraulic cylinders. As shown in FIG. 1, the hydraulic exerciser 1 comprises a base 13 and a pair of driven units 11, 12 mounted pivotably on the base 13 at one end. An elongated hollow support 14 is secured on the base 13 and extends between the driven units 11, 12.

Referring to FIGS. 1 and 2, each of a pair of hydraulic cylinders 2 has a cylinder body 20, a piston 24 disposed movably inside the cylinder body 20, and a piston rod 26 which has a first end connected to the piston 24 and a second end which extends out of the cylinder body 20 and which is connected to a respective one of the driven units 2.

A metal tubular connector 3 is secured on the support 14 and extends between the driven units 11, 12. The tubular connector 3 has two ends that extend through opposite ends of the support 14 so as to permit mounting of the cylinder bodies 20 of the hydraulic cylinders 2 thereon. The tubular connector 3 has a flexible rubber tube 31 provided therein. The tubular connector 3 is further provided with a threaded radial bore which receives the threaded shank of a rotary knob 32. The rotary knob 32 is operable in order to pinch a portion of the rubber tube 31 and regulate the flow of fluid therethrough.

A rigid tubular end piece 4 is provided at each end of the rubber tube 31. Each tubular end piece 4 has a tapered portion 41 which is fitted in the respective end of the rubber tube 31 and which causes the respective end of the rubber tube 31 to expand and press tightly against the tubular connector 3 in order to seal the gap between the rubber tube 31 and the tubular connector 3. Each of the tubular end pieces 4 defines a fluid path 42 and is provided with a radial hole 43 which is communicated with the fluid path 42. A cap 34 is mounted threadedly on each end of the tubular connector 3 and is used to retain the end pieces 4 and the rubber tube 31 inside the tubular connector 3. A clearance 33 is formed between a portion of the tubular end piece 4 and the tubular connector 3. One of the caps 5 is provided with a fluid inlet 35. The fluid inlet 35 is adapted to be connected to a hydraulic fluid supply (A) which is used to remove or supply hydraulic fluid to the rubber tube 31.

Referring to FIGS. 2 and 3, the cylinder body 20 of each hydraulic cylinder 2 has one end which is provided with a plug 22. The plug 22 is formed with a ring connector 221 that defines a through hole 23. The plug 22 is further provided with an axial fluid hole 21 which communicates the interior of the cylinder body 20 with the through hole 23. The plug 22 cooperates with the cylinder body 20 and the piston 24 so as to define a volume variable fluid chamber 25 which is filled with hydraulic fluid. The ring connectors 221 of the hydraulic cylinders 2 are sleeved on a respective end of the tubular connector 3, thereby mounting pivotably the hydraulic cylinders 2 on the tubular connector 3. Each end of the tubular connector 3 is further provided with an annular peripheral groove 37 and a fluid hole 36 that is formed in the peripheral groove 37. The peripheral groove 37 is aligned with the fluid hole 21 of the plug 22 and permits the flow of hydraulic fluid from the fluid chamber 25 to the clearance 33 via the fluid hole 36, and vice versa.

Whenever a downward pushing force is applied on one of the driven units 11, 12, the piston 24 of the corresponding hydraulic cylinder 2 moves downward, thereby causing the hydraulic fluid inside the fluid chamber 25 to flow through the fluid hole 21, the peripheral groove 37, the fluid hole 36, the clearance 33, the radial hole 43 of one of the tubular end pieces 4, the fluid path 42 and into the rubber tube 31. Fluid inside the rubber tube 31 then flows through the fluid path 42 of the other tubular end piece 4, the radial hole 43, the clearance 33, the fluid hole 36, the peripheral groove 37, the fluid hole 21 and into the fluid chamber 25 of the other hydraulic cylinder 2. The entry of hydraulic fluid in the fluid chamber 25 causes upward movement of the piston 24 in the other hydraulic cylinder 2, thereby resulting in upward movement of the other one of the driven units 11, 12.

Some of the drawbacks of the above described hydraulic exerciser 1 are as follows:

1. The ring connectors 221 mount pivotably the hydraulic cylinders 2 on the tubular connector 3. In order to ensure proper pivoting movement of the hydraulic cylinders 2 while preventing leakage of high temperature, high pressure hydraulic fluid, a high degree of precision is needed when forming the ring connectors 221 and the tubular connector 3.

2. The rotary knob 32 and the rubber tube 31 constitute a regulator for varying the resistance offered by the hydraulic cylinders 2 to movement of the driven units 11, 12. It is noted that the tip of the rotary knob 32 abuts a portion of the rubber tube 31 in order to pinch the latter. Due to the relatively large fluid pressure in the rubber tube 31, the tip of the rotary knob 32 can damage easily the rubber tube 31. In addition, the tubular end pieces 4 cause the two ends of the rubber tube 31 to expand and press tightly against the tubular connector 3 in order to seal the gap between the rubber tube 31 and the tubular connector 3. Damage to the rubber tube 31 easily occurs because the two ends thereof are maintained in a stretched state.

3. The hydraulic exerciser 1 has numerous components, thereby complicating the manufacture and assembly thereof.

SUMMARY OF THE INVENTION

Therefore, the objective of the present invention is to provide a hydraulic exerciser which can overcome the above mentioned drawbacks that are commonly associated with the previously described conventional hydraulic exerciser.

Accordingly, the hydraulic exerciser of the present invention comprises a base, a pair of driven units mounted pivotably on the base, an elongated hollow support secured on the base and extending between the driven units, the hollow support being formed with an axial through bore, and a pair of hydraulic cylinders. Each of the hydraulic cylinders includes a cylinder body, a piston disposed movably inside the cylinder body, a piston rod having a first end connected to the piston and a second end which extends out of the cylinder body and which is connected to a respective one of the driven units, and a plug unit which is secured on one end of the cylinder body and which mounts pivotably the cylinder body on a respective one of two ends of the hollow support. The piston, the cylinder body and the plug unit cooperatively define a volume variable fluid chamber which is filled with hydraulic fluid. The plug unit is formed with a fluid passage for communicating the fluid chamber and the through bore of the hollow support.

The plug unit includes a first plug member extending sealingly and securely into the cylinder body and having an axial threaded extension which extends out of the cylinder body, and a second plug member having a head section formed with a radial threaded hole which engages threadedly the threaded extension and a shank section extending sealingly and rotatably into the respective one of the two ends of the hollow support.

The fluid passage includes an axial hole formed through the first plug member and an axial blind hole formed through the shank section of the second plug member and communicated fluidly with the axial hole of the first plug member.

The shank section of the second plug member is formed with an annular peripheral groove. Each of the two ends of the hollow support is formed with a radial pin hole that is aligned with the annular peripheral groove of a corresponding second plug member. The plug unit further includes a pin extending into a corresponding pin hole and the annular peripheral groove of the second plug member to mount rotatably the second plug member on the hollow support.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
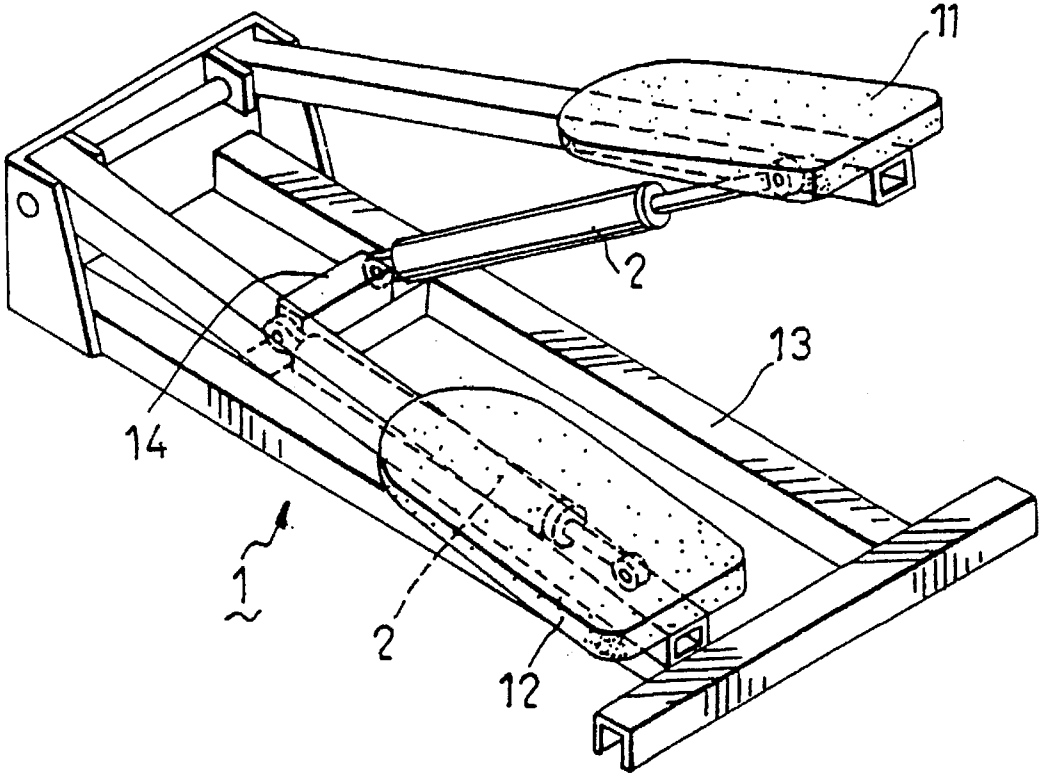
FIG. 1 (PRIOR ART)
FIG. 1 is a perspective of the hydraulic exerciser disclosed in U.S. Pat. No. 5,236,407.
Figure 2:
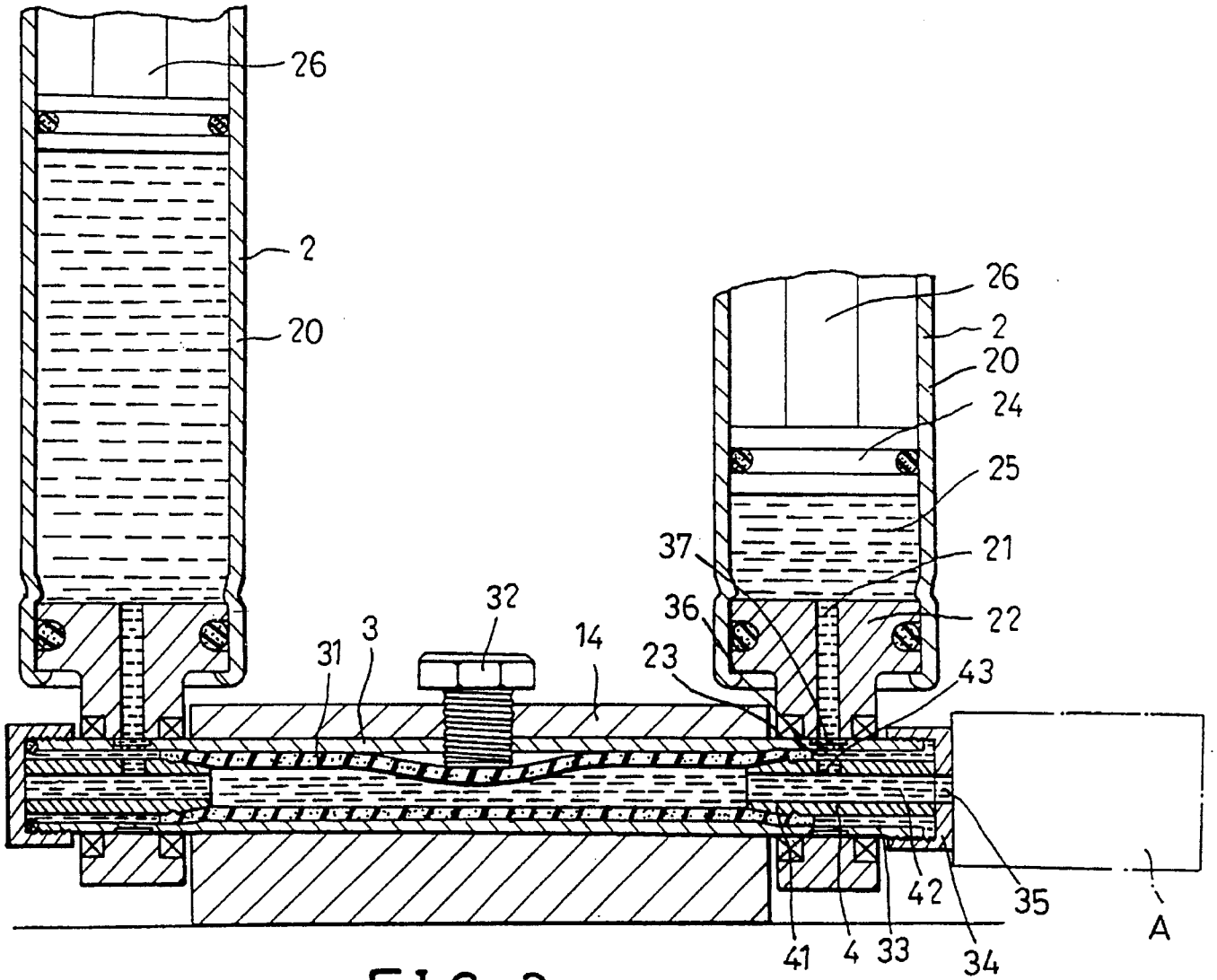
FIG. 2 (PRIOR ART)
FIG. 2 is a sectional view of the hydraulic exerciser shown in FIG. 1.
Figure 3:
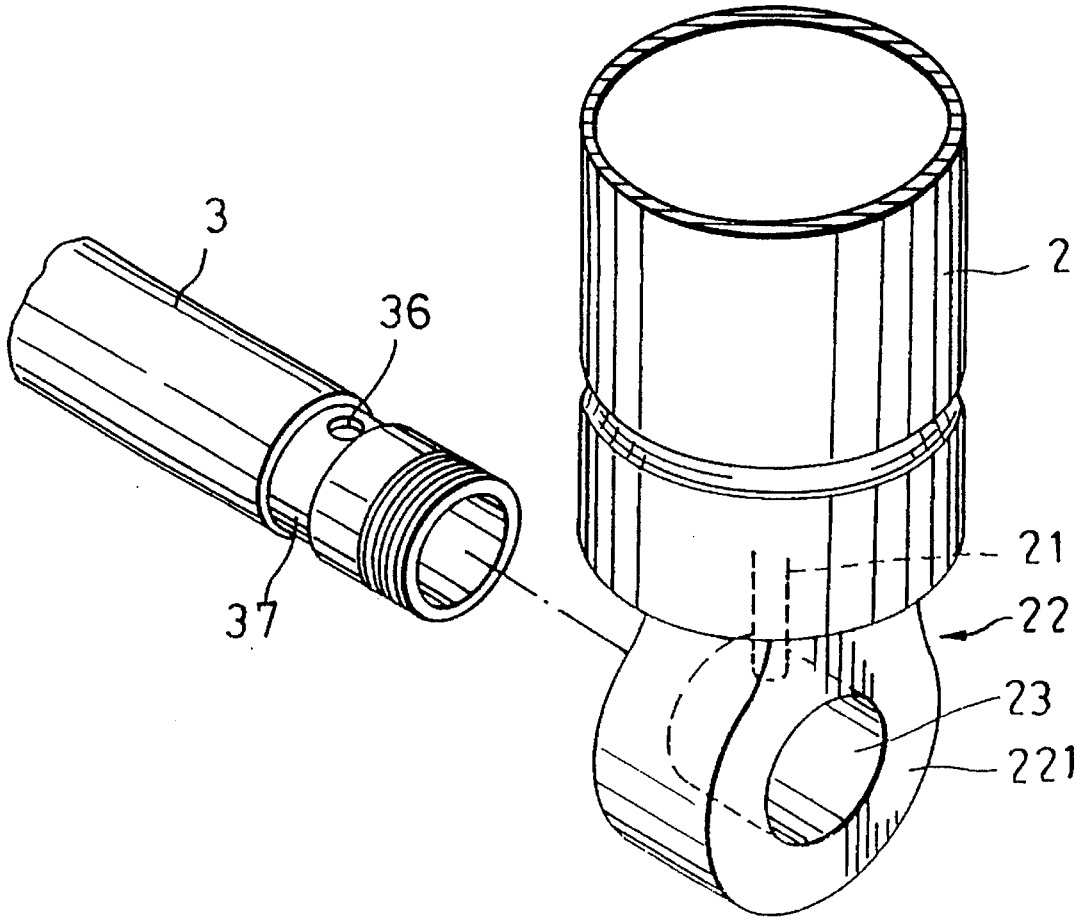
FIG. 3 (PRIOR ART)
FIG. 3 is an exploded view which illustrates how a hydraulic cylinder of the conventional hydraulic exerciser is mounted pivotally on one end of a tubular connector.
Figure 4:
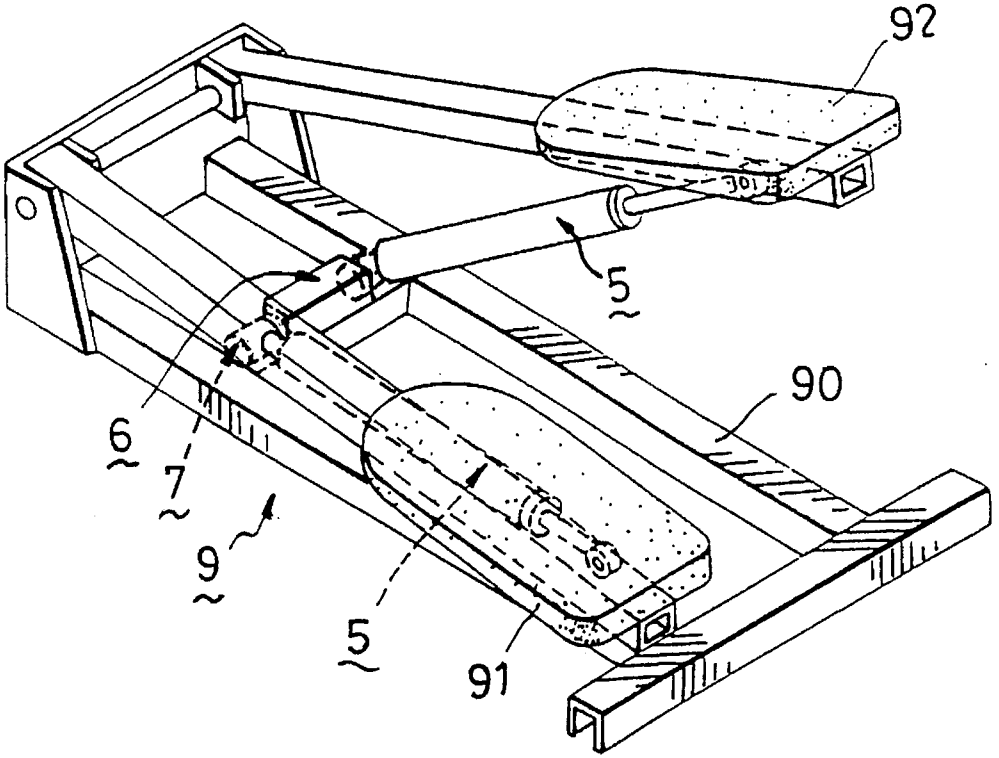
FIG. 4 is a perspective of the preferred embodiment of a hydraulic exerciser according to the present invention.

Referring to FIG. 4, the preferred embodiment of a hydraulic exerciser 9 according to the present invention is shown to comprise a base 90 and a pair of driven units 91, 92 mounted pivotably on the base 90. An elongated hollow support 6, which is made of metal, is secured on the base 90 and extends between the driven units 91, 92.

Figure 5:
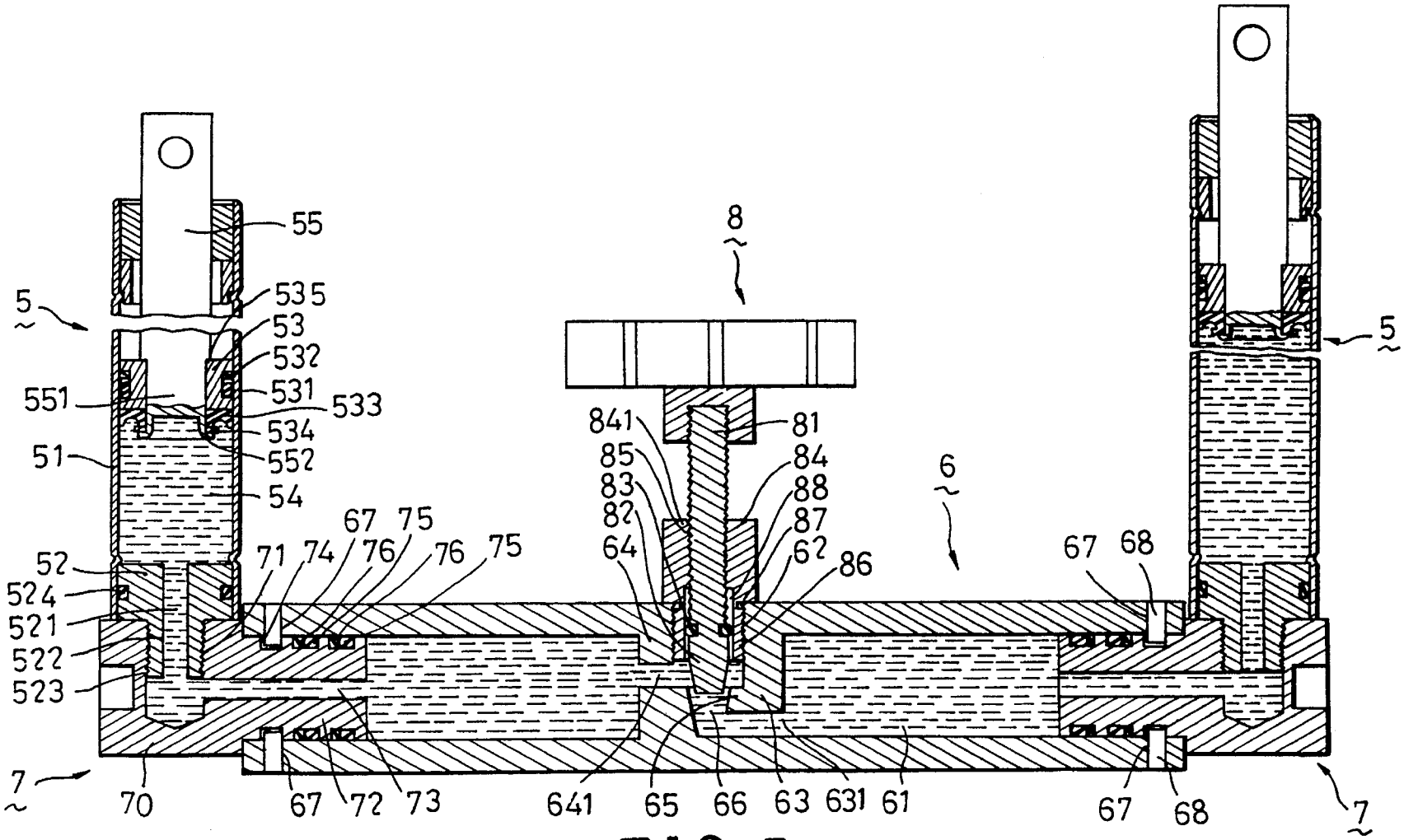
FIG. 5 is a sectional view of the hydraulic exerciser of the present invention.

Referring to FIGS. 4 and 5, each of a pair of hydraulic cylinders 5 includes a cylinder body 51, a piston 53 disposed movably inside the cylinder body 51, and a piston rod 55 having a first end connected to the piston 53 and a second end extending out of the cylinder body 51 and connected to a respective one of the driven units 91, 92. A plug unit includes a first plug member 52 which extends sealingly and securely into one end of the cylinder body 51. The first plug member 52 is provided with an axial hole 521 and an axial extension 522 which is formed with an external screw thread 523 and which extends out of the cylinder body 51. A sealing ring 524 is disposed fittingly between the outer periphery of the first plug member 52 and the cylinder body 51 to prevent leakage. The piston 53 and the cylinder body 51 cooperate with the first plug member 52 to define a volume variable fluid chamber 54 which is filled with hydraulic fluid. A sealing ring 531 and a backing ring 532 are interposed fittingly between the piston 53 and the cylinder body 51. The piston 53 has one end adjacent to the fluid chamber 54 which is provided with a sealing element 533 and a washer 534. The tip 551 of the piston rod 55 extends through an axial hole 535 in the piston 53 and has a bent flange portion 552 which prevents the disengagement of the sealing element 533 and the washer 534 from the piston rod 55.

The hollow support 6 is formed as a die cast metal bar that is generally rectangular in cross-section. The hollow support 6 is formed with an axial through bore 61 and has an intermediate portion with a threaded radial bore 62. The hollow support 6 is further formed with a partition unit which divides the hollow support 6 into two parts and which includes a spaced pair of partition walls 63, 64 on two sides of the radial bore 62. The partition wall 63 is formed with a passage 631 for communicating the space between the partition walls 63, 64 and one part of the hollow support 6. The partition wall 64 is formed with a passage 641 that is disposed above the passage 631 and that serves to communicate the space between the partition walls 63, 64 and the other part of the hollow support 6. The partition walls 63, 64 are further formed with a valve seat 65 between the passages 631, 641. The valve seat 65 is formed with a valve opening 66 which is aligned axially with the radial bore 62 and which has a size that decreases gradually in a direction away from the radial bore 62. The two ends of the hollow support 6 are respectively formed with a pair of radial pin holes 67.

An internally and externally threaded seat 84 is formed with an internally threaded axial bore 85 and has a head portion 841 and an externally threaded shank portions 86 which engages threadably the radial bore 62 in the hollow support 6. A sealing ring 87 is disposed at the junction of the head portion 841 and the shank portion 86 to block undesired fluid flow through the radial bore 62. The shank portion 86 is further formed with an axial blind bore 88.

A rotary knob 8 has a threaded shank 81 which extends threadably into the axial bore 85 of the seat 84 and which has a tip 82 that complements the shape of the valve opening 66. A sealing ring 83 is provided fittingly between the threaded shank 81 and the inner wall surface of the blind bore 88 to prevent undesired fluid flow through the axial bore 85 of the seat 84.

Figure 6:
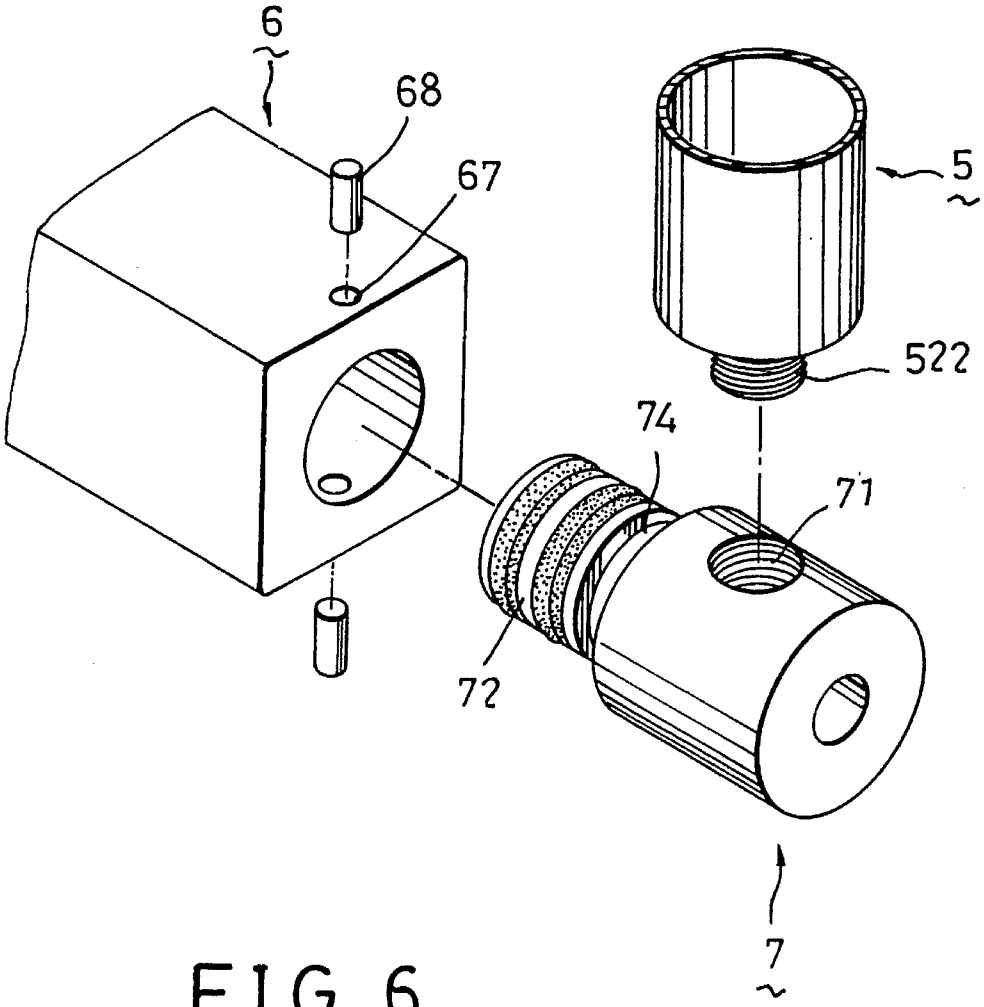
FIG. 6 is an exploded view which illustrates how a hydraulic cylinder of the preferred embodiment is mounted pivotally on one end of a hollow support.

Referring to FIGS. 5 and 6, the plug unit of each hydraulic cylinder 5 further includes a second plug member 7, each of which has a head section 70 formed with a radial threaded hole 71 which engages threadedly the axial extension 522 of the first plug member 52, and a shank section 72 that is inserted sealingly and rotatably into the corresponding end of the hollow support 6. Preferably, the axial extension 522 is coated with a layer of a known metal binding agent to bond firmly the first plug members 52 to the second plug members 7. The shank section 72 is formed with an annular groove 74 that is aligned with the pin holes 67 in the corresponding end of the hollow support 6. Two sets of sealing rings 75 and backing rings 76 are disposed between the shank section 72 and the surface defining the through bore 61 of the hollow support 6 to prevent hydraulic fluid from leaking through the two ends of the hollow support 6. A pin 68 is inserted into each of the pin holes 67 and extends into the annular groove 74 of the corresponding second plug member 7 to mount the plug units pivotably on the two ends of the hollow support 6. The shank section 72 is further formed with an axial blind hole 73 that is communicated with the radial threaded hole 71. In each plug unit, the axial hole 521 in the first plug member 52 and the blind hole 73 in the second plug member 7 serve as a fluid passage for communicating the fluid chamber 54 of the respective cylinder body 51 and the through bore 61 of the hollow support 6.

In operation, whenever a downward pushing force is applied on one of the driven units 91, 92, the piston 53 of the corresponding hydraulic cylinder 5 moves downward, thereby causing the hydraulic fluid inside the fluid chamber 54 to flow through the fluid passage of the corresponding plug unit and into the hollow support 6. Fluid inside the hollow support 6 then flows through the partition unit, the fluid passage of the other plug unit and into the fluid chamber 54 of the other hydraulic cylinder 5. The entry of hydraulic fluid in the fluid chamber 54 causes upward movement of the piston 53 in the other hydraulic cylinder 5, thereby resulting in upward movement of the other one of the driven units 91, 92.

In order to suit the needs of different users, the rotary knob 8 can be operated so as to vary the degree of insertion of the tip 82 of the threaded shank 81 into the valve opening 66, thereby regulating the flow of hydraulic fluid through the passages 631, 641. As a result, the transfer of hydraulic fluid between the hydraulic cylinders 5 can be regulated to vary the resistance offered by the hydraulic cylinders 5 to the movement of the driven units 91, 92.

Some of the advantages and characterizing features of the hydraulic exerciser 9 of the present invention are as follows:

1. The assembly of the plug units and the hollow support 6 can be easily and conveniently accomplished while ensuring that no leakage will occur.

2. Unlike the previously described conventional hydraulic exerciser 1, no flexible rubber tube is employed in the present invention, thereby obviating the drawbacks associated with the use of the rubber tube.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A hydraulic exerciser including a base;

a pair of driven units mounted pivotably on said base;

an elongated hollow support secured on said base and extending between said driven units, said hollow support having an axial through bore formed therethrough; and a pair of hydraulic cylinders, each of said hydraulic cylinders including a cylinder body, a piston disposed movably inside said cylinder body, a piston rod having a first end connected to said piston and a second end which extends out of said cylinder body and which is connected to a respective one of said driven units, and a plug unit which is secured on one end of said cylinder body and which mounts pivotably said cylinder body on a respective one of two ends of said hollow support;

said piston, said cylinder body and said plug unit cooperatively defining a volume variable fluid chamber which is filled with hydraulic fluid;

said plug unit being formed with a fluid passage for communicating said fluid chamber and said through bore of said hollow support;

wherein said plug unit includes a first plug member extending sealingly and securely into said one end of said cylinder body and having an axial threaded extension which extends out of said one end of said cylinder body, and a second plug member having a head section formed with a radial threaded hole which engages threadedly said threaded extension and a shank section extending sealingly and rotatably into said respective one of said two ends of said hollow support;

wherein said fluid passage includes an axial hole formed through said first plug member and an axial blind hole formed through said shank section of said second plug member and communicated fluidly with said axial hole of said first plug member; and wherein said shank section of said second plug member is formed with an annular peripheral groove, each of said two ends of said hollow support being formed with a radial pin hole that is aligned with said annular peripheral groove of a corresponding said second plug member, said plug unit further including a pin extending into a corresponding said pin hole and said annular peripheral groove of said second plug member to mount rotatably said second plug member on said hollow support.

2. The hydraulic exerciser as claimed in claim 1, wherein:

said hollow support has an intermediate portion formed with a threaded radial bore and a partition unit which divides said hollow support into two parts and which includes a spaced pair of partition walls on two sides of said radial bore, one of said partition walls being formed with a first passage for communicating a space between said partition walls and one of said parts of said hollow support, the other one of said partition walls being formed with a second passage that is disposed above said first passage and that serves to communicate the space between said partition walls and the other one of said parts of said hollow support, said partition walls being further formed with a valve seat between said first and second passages, said valve seat being formed with a valve opening which is aligned axially with said radial bore and which has a size that decreases gradually in a direction away from said radial bore; and said hydraulic exerciser further includes a rotary knob having a threaded shank which extends threadably through said radial bore and which has a tip that complements said valve opening, said rotary knob being operable so as to vary the degree of insertion of said tip inside said valve opening in order to regulate transfer of said hydraulic fluid between said hydraulic cylinders.

* * * * *